US008007699B2

(12) United States Patent
Bieser et al.

(10) Patent No.: US 8,007,699 B2
(45) Date of Patent: Aug. 30, 2011

(54) PROCESS OF MAKING BICOMPONENT FIBER

(75) Inventors: John Bieser, Houston, TX (US); Guillaume Pavy, Ixelles (BE); Hughes Haubruge, Walhain (BE); Alain Sandaert, Lacken (BE); William R. Wheat, Houston, TX (US)

(73) Assignee: Fina Technology, Inc., Houston, TX (US)

( * ) Notice: Subject to any disclaimer, the term of this patent is extended or adjusted under 35 U.S.C. 154(b) by 0 days.

(21) Appl. No.: 12/194,965

(22) Filed: Aug. 20, 2008

(65) Prior Publication Data

US 2010/0047571 A1 Feb. 25, 2010

(51) Int. Cl.

| | |
|---|---|
| ***D01D 5/34*** | (2006.01) |
| ***D01F 6/06*** | (2006.01) |
| ***D04H 3/02*** | (2006.01) |

(52) U.S. Cl. ..... 264/103; 264/172.15

(58) Field of Classification Search ..... 264/103, 264/172.15

See application file for complete search history.

(56) References Cited

U.S. PATENT DOCUMENTS

| | | | | |
|---|---|---|---|---|
| 5,672,415 | A | 9/1997 | Sawyer et al. | |
| 5,972,497 | A * | 10/1999 | Hirwe et al. | 428/361 |
| 6,632,504 | B1 | 10/2003 | Gillespie et al. | |
| 6,723,669 | B1 | 4/2004 | Clark et al. | |
| 6,831,025 | B2 | 12/2004 | Rudisill et al. | |
| 2004/0038612 | A1 | 2/2004 | Forbes et al. | |
| 2004/0116024 | A1 * | 6/2004 | Zafiroglu et al. | 442/334 |
| 2005/0165173 | A1 | 7/2005 | Autran | |
| 2008/0311814 | A1 * | 12/2008 | O'Sickey et al. | 442/329 |

* cited by examiner

*Primary Examiner* — Leo B Tentoni

(57) ABSTRACT

Bicomponent fibers, methods of forming bicomponent fibers and articles formed from bicomponent fibers are described herein. The bicomponent fibers generally include a sheath component and a core component, wherein the sheath component consists essentially of a first metallocene polypropylene and the core component consists essentially of a second metallocene polypropylene.

6 Claims, No Drawings

PROCESS OF MAKING BICOMPONENT FIBER

FIELD

Embodiments of the present invention generally relate to bicomponent fibers prepared from polypropylene. In particular, embodiments generally relate to bicomponent fibers prepared from metallocene formed polypropylene.

BACKGROUND

Bicomponent spunbond fabrics are increasingly being used for hygiene, medical and other non-woven applications. Traditionally, bicomponent spunbond fabrics include a sheath formed of a first polymer, such as polyester or polypropylene, and a core formed of a second polymer, such as polyethylene. Attempts have been made to form both the sheath and the core of bicomponent spunbond fibers from polypropylene. However, such attempts have still utilized incompatible polymers (such as different catalysts to form the polymers or different types of polymers) as the core and sheath. These structures formed of dissimilar polymers present challenges to the proccessability of spunbound fabrics. Accordingly, there remains a need for spunbond fabrics having improved proccessability.

SUMMARY

Embodiments of the present invention include bicomponent fibers. The bicomponent fibers generally include a sheath component and a core component, wherein the sheath component consists essentially of a first metallocene polypropylene and the core component consists essentially of a second metallocene polypropylene.

One or more embodiments include spunbond non-woven articles formed by the bicomponent fiber.

One or more embodiments include a process of forming a bicomponent fiber. The process generally includes providing a first metallocene polypropylene having a first melting temperature and a second metallocene polypropylene having a second melting temperature, melting the first and second metallocene polypropylenes at their respective first and second melting temperatures, thereby providing a first and second melted metallocene polypropylene and forming the first and second melted metallocene polypropylenes into a bicomponent fiber including a sheath component formed from the first metallocene polypropylene and a core component formed from the second metallocene polypropylene.

DETAILED DESCRIPTION

Introduction and Definitions

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions when the information in this patent is combined with available information and technology.

Various terms as used herein are shown below. To the extent a term used in a claim is not defined below, it should be given the broadest definition persons in the pertinent art have given that term as reflected in printed publications and issued patents at the time of filing. Further, unless otherwise specified, all compounds described herein may be substituted or unsubstituted and the listing of compounds includes derivatives thereof.

Various ranges are further recited below. It should be recognized that unless stated otherwise, it is intended that the endpoints are to be interchangeable. Further, any point within that range is contemplated as being disclosed herein.

Embodiments of the present invention relate to bicomponent fibers. The bicomponent fibers have a core and a sheath component formed of polypropylene. Specifically, the core and sheath components are formed from metallocene polypropylene (i.e., polypropylene formed from polymerization with a metallocene catalyst). For the purposes of the present invention, the terms "skin" and "sheath" may be used interchangeably and, as such, should be considered to have identical meanings. In addition, the terms "fiber" and "filament" may be used interchangeably and, as such, should be considered to have identical meanings.

Catalyst Systems

Catalyst systems useful for polymerizing olefin monomers can include metallocene catalyst systems, single site catalyst systems, Ziegler-Natta catalyst systems or combinations thereof, for example. A brief discussion of metallocene catalyst systems is included below, but is in no way intended to limit the scope of the invention to such catalysts.

Metallocene catalysts may be characterized generally as coordination compounds incorporating one or more cyclopentadienyl (Cp) groups (which may be substituted or unsubstituted, each substitution being the same or different) coordinated with a transition metal.

The substituent groups on Cp may be linear, branched or cyclic hydrocarbyl radicals, for example. The inclusion of cyclic hydrocarbyl radicals may transform the Cp into other contiguous ring structures, such as indenyl, azulenyl and fluorenyl groups, for example. These contiguous ring structures may also be substituted or unsubstituted by hydrocarbyl radicals, such as $C_1$ to $C_{20}$ hydrocarbyl radicals, for example.

A specific, non-limiting, example of a metallocene catalyst is a bulky ligand metallocene compound generally represented by the formula:

$$[L]_m M[A]_n;$$

wherein L is a bulky ligand, A is a leaving group, M is a transition metal and m and n are such that the total ligand valency corresponds to the transition metal valency. For example m may be from 1 to 4 and n may be from 0 to 3.

The metal atom "M" of the metallocene catalyst compound, as described throughout the specification and claims, may be selected from Groups 3 through 12 atoms and lanthanide Group atoms, or from Groups 3 through 10 atoms or from Sc, Ti, Zr, Hf, V, Nb, Ta, Mn, Re, Fe, Ru, Os, Co, Rh, Ir and Ni. The oxidation state of the metal atom "M" may range from 0 to +7 or is +1, +2, +3, +4 or +5, for example.

The bulky ligand generally includes a cyclopentadienyl group (Cp) or a derivative thereof. The Cp ligand(s) form at least one chemical bond with the metal atom M to form the "metallocene catalyst." The Cp ligands are distinct from the leaving groups bound to the catalyst compound in that they are not as highly susceptible to substitution/abstraction reactions as the leaving groups.

Cp ligands may include ring(s) or ring system(s) including atoms selected from group 13 to 16 atoms, such as carbon, nitrogen, oxygen, silicon, sulfur, phosphorous, germanium, boron, aluminum and combinations thereof, wherein carbon makes up at least 50% of the ring members. Non-limiting examples of the ring or ring systems include cyclopentadienyl, cyclopentaphenanthreneyl, indenyl, benzindenyl, fluorenyl, tetrahydroindenyl, octahydrofluorenyl, cyclooctatetraenyl, cyclopentacyclododecene, 3,4-benzofluorenyl, 9-phenylfluorenyl, 8-H-cyclopent[a]acenaphthylenyl, 7-H-dibenzofluorenyl, indeno[1,2-9]anthrene, thiophenoindenyl, thiophenofluorenyl, hydrogenated versions thereof (e.g., 4,5,6,7-tetrahydroindenyl or "$H_4$Ind"), substituted versions thereof and heterocyclic versions thereof, for example.

Cp substituent groups may include hydrogen radicals, alkyls (e.g., methyl, ethyl, propyl, butyl, pentyl, hexyl, fluoromethyl, fluoroethyl, difluoroethyl, iodopropyl, bromohexyl, benzyl, phenyl, methylphenyl, tert-butylphenyl, chlorobenzyl, dimethylphosphine and methylphenylphosphine), alkenyls (e.g., 3-butenyl, 2-propenyl and 5-hexenyl), alkynyls, cycloalkyls (e.g., cyclopentyl and cyclohexyl), aryls, alkoxys (e.g., methoxy, ethoxy, propoxy and phenoxy), aryloxys, alkylthiols, dialkylamines (e.g., dimethylamine and diphenylamine), alkylamidos, alkoxycarbonyls, aryloxycarbonyls, carbamoyls, alkyl- and dialkyl-carbamoyls, acyloxys, acylaminos, aroylaminos, organometalloid radicals (e.g., dimethylboron), Group 15 and Group 16 radicals (e.g., methylsulfide and ethylsulfide) and combinations thereof, for example. In one embodiment, at least two substituent groups, two adjacent substituent groups in one embodiment, are joined to form a ring structure.

Each leaving group "A" is independently selected and may include any ionic leaving (group, such as halogens (e.g., chloride and fluoride), hydrides, $C_1$ to $C_{12}$ alkyls (e.g., methyl, ethyl, propyl, phenyl, cyclobutyl, cyclohexyl, heptyl, tolyl, trifluoromethyl, methylphenyl, dimethylphenyl and trimethylphenyl), $C_2$ to $C_{12}$ alkenyls (e.g., $C_2$ to $C_6$ fluoroalkenyls), $C_6$ to $C_{12}$ aryls (e.g., $C_7$ to $C_{20}$ alkylaryls), $C_1$ to $C_{12}$ alkoxys (e.g., phenoxy, methyoxy, ethyoxy, propoxy and benzoxy), $C_6$ to $C_{16}$ aryloxys, $C_7$ to $C_{18}$ alkylaryloxys and $C_1$ to $C_{12}$ heteroatom-containing hydrocarbons and substituted derivatives thereof, for example.

Other non-limiting examples of leaving groups include amines, phosphines, ethers, carboxylates (e.g., $C_1$ to $C_6$ alkylcarboxylates, $C_6$ to $C_{12}$ arylcarboxylates and $C_7$ to $C_{18}$ alkylarylcarboxylates), dienes, alkenes, hydrocarbon radicals having from 1 to 20 carbon atoms (e.g., pentafluorophenyl) and combinations thereof, for example. In one embodiment, two or more leaving groups form a part of a fused ring or ring system.

In a specific embodiment, L and A may be bridged to one another to form a bridged metallocene catalyst. A bridged metallocene catalyst, for example, may be described by the general formula:

$$XCp^ACp^BMA_n;$$

wherein X is a structural bridge, $Cp^A$ and $Cp^B$ each denote a cyclopentadienyl group or derivatives thereof, each being the same or different and which may be either substituted or unsubstituted, M is a transition metal and A is an alkyl, hydrocarbyl or halogen group and n is an integer between 0 and 4, and either 1 or 2 in a particular embodiment.

Non-limiting examples of bridging groups "X" include divalent hydrocarbon groups containing at least one Group 13 to 16 atom, such as, but not limited to, at least one of a carbon, oxygen, nitrogen, silicon, aluminum, boron, germanium, tin and combinations thereof; wherein the heteroatom may also be a $C_1$ to $C_{12}$ alkyl or aryl group substituted to satisfy a neutral valency. The bridging group may also contain substituent groups as defined above including halogen radicals and iron. More particular non-limiting examples of bridging group are represented by $C_1$ to $C_6$ alkylenes, substituted $C_1$ to $C_6$ alkylenes, oxygen, sulfur, $R_2C{=}$, $R_2Si{=}$, $-Si(R)_2Si(R_2)-$, $R_2Ge{=}$ or $RP{=}$ (wherein "=" represents two chemical bonds), where R is independently selected from hydrides, hydrocarbyls, halocarbyls, hydrocarbyl-substituted organometalloids, halocarbyl-substituted organometalloids, disubstituted boron atoms, disubstituted Group 15 atoms, substituted Group 16 atoms and halogen radicals, for example. In one embodiment, the bridged metallocene catalyst component has two or more bridging groups.

Other non-limiting examples of bridging groups include methylene, ethylene, ethylidene, propylidene, isopropylidene, diphenylmethylene, 1,2-dimethylethylene, 1,2-diphenylethylene, 1,1,2,2-tetramethylethylene, dimethylsilyl, dimethylsilyl, methyl-ethylsilyl, trifluoromethylbutylsilyl, bis(trifluoromethyl)silyl, di(n-butyl)silyl, di(n-propyl)silyl, di(i-propyl)silyl, di(n-hexyl)silyl, dicyclohexylsilyl, diphenylsilyl, cyclohexylphenylsilyl, t-butylcyclohexylsilyl, di(t-butylphenyl)silyl, di(p-tolyl)silyl and the corresponding moieties, wherein the Si atom is replaced by a Ge or a C atom; dimethylsilyl, dimethylsilyl, dimethiylgermyl and/or diethylgermyl.

In another embodiment, the bridging group may also be cyclic and include 4 to 10 ring members or 5 to 7 ring members, for example. The ring members may be selected from the elements mentioned above and/or from one or more of boron, carbon, silicon, germanium, nitrogen and oxygen, for example. Non-limiting examples of ring structures which may be present as or part of the bridging moiety are cyclobutylidene, cyclopentylidene, cyclohexylidene, cycloheptylidene, cyclooctylidene, for example. The cyclic bridging groups may be saturated or unsaturated and/or carry one or more substituents and/or be fused to one or more other ring structures. The one or more Cp groups which the above cyclic bridging moieties may optionally be fused to may be saturated or unsaturated. Moreover, these ring structures may themselves be fused, such as, for example, in the case of a naphthyl group.

In one embodiment, the metallocene catalyst includes CpFlu Type catalysts (e.g., a metallocene catalyst wherein the ligand includes a Cp fluorenyl ligand structure) represented by the following formula:

$$X(CpR^1_nR^2_m)(FlR^3_p);$$

wherein Cp is a cyclopentadienyl group or derivatives thereof, Fl is a fluorenyl group, X is a structural bridge between Cp and Fl, $R^1$ is an optional substituent on the Cp, n is 1 or 2, $R^2$ is an optional substituent on the Cp bound to a carbon immediately adjacent to the ipso carbon, m is 1 or 2 and each $R^3$ is optional, may be the same or different and may be selected from $C_1$ to $C_{20}$ hydrocarbyls. In one embodiment, p is selected from 2 or 4. In one embodiment, at least one $R^3$ is substituted in either the 2 or 7 position on the fluorenyl group and at least one other $R^3$ being substituted at an opposed 2 or 7 position on the fluorenyl group.

In yet another aspect, the metallocene catalyst includes bridged mono-ligand metallocene compounds (e.g., mono cyclopentadienyl catalyst components). In this embodiment, the metallocene catalyst is a bridged "half-sandwich" metallocene catalyst. In yet another aspect of the invention, the at least one metallocene catalyst component is an unbridged "half sandwich" metallocene. (See, U.S. Pat. No. 6,069,213, U.S. Pat. No. 5,026,798, U.S. Pat. No. 5,703,187, U.S. Pat. No. 5,747,406, U.S. Pat. No. 5,026,798 and U.S. Pat. No. 6,069,213, which are incorporated by reference herein.)

Non-limiting examples of metallocene catalyst components consistent with the description herein include, for example cyclopentadienylzirconium$A_n$; indenylzirconium$A_n$; (1-methylindenyl)zirconium$A_n$; (2-methylindenyl)zirconium$A_n$, (1-propylindenyl)zirconium$A_n$; (2-propylindenyl)zirconium$A_n$; (1-butylindenyl)zirconium$A_n$; (2-butylindenyl)zirconium$A_n$; methylcyclopentadienylzirconium$A_n$; tetrahydroindenylzirconium$A_n$; pentamethylcyclopentadienylzirconium$A_n$; cyclopentadienylzirconium$A_n$; pentamethylcyclopentadienyltitanium$A_n$; tetramethylcyclopentyltitanium$A_n$; (1,2,4-trimethylcyclopentadienyl)zirconium$A_n$; dimethylsilyl(1,2,3,4-tetramethylcyclopentadienyl)(cyclopentadienyl)zirconium$A_n$; dimethylsilyl(1,2,3,4-tetramethylcyclopentadienyl)(1,2,3-trimethylcyclopentadienyl)zirconium$A_n$; dimethylsilyl(1,2,3,4-tetramethylcyclopentadienyl)(1,2-dimethylcyclopentadienyl)zirconium$A_n$; dimethylsilyl(1,2,3,4-tetramethylcyclopentadienyl)(2-methylcyclopentadienyl)zirconium$A_n$; dimethylsilylcyclopentadienylindenylzirconium$A_n$; dimethylsilyl(2-methylindenyl)(fluorenyl)zirconium$A_n$; diphenylsilyl(1,2,3,4-tetramethylcyclopentadienyl)(3-propylcyclopentadienyl)zirconium$A_n$; dimethylsilyl(1,2,3,4-tetramethylcyclopentadienyl)(3-t-butylcyclopentadienyl)zirconium$A_n$; dimethylgermyl(1,2-dimethylcyclopentadienyl)(3-isopropylcyclopentadienyl)zirconium$A_n$; dimethylsilyl(1,2,3,4-tetramethylcyclopentadienyl)(3-methylcyclopentadienyl)zirconium$A_n$; diphenylmethylidene(cyclopentadienyl)(9-fluorenyl)zirconium$A_n$; diphenylmethylidenecyclopentadienylindenylzirconium$A_n$; isopropylidenebiscyclopentadienylzirconium$A_n$; isopropylidene(cyclopentadienyl)(9-fluorenyl)zirconium$A_n$; isopropylidene(3-methylcyclopentadienyl)(9-fluorenyl)zirconium$A_n$; ethylenebis(9-fluorenyl)zirconium$A_n$; ethylenebis(1-indenyl)zirconium$A_n$; ethylenebis(1-indenyl)zirconium$A_n$; ethylenebis(2-methyl-1-indenyl)zirconium$A_n$; ethylenebis(2-methyl-4,5,6,7-tetrahydro-1-indenyl)zirconium$A_n$; ethylenebis(2-propyl-4,5,6,7-tetrahydro-1-indenyl)zirconium$A_n$; ethylenebis(2-isopropyl-4,5,6,7-tetrahydro-1-indenyl)zirconium$A_n$; ethylenebis(2-butyl-4,5,6,7-tetrahydro-1-indenyl)zirconium$A_n$; ethylenebis(2-isobutyl-4,5,6,7-tetrahydro-1-indenyl)zirconium$A_n$; dimethylsilyl(4,5,6,7-tetrahydro-1-indenyl)zirconium$A_n$; diphenyl(4,5,6,7-tetrahydro-1-indenyl)zirconium$A_n$; ethylenebis(4,5,6,7-tetrahydro-1-indenyl)zirconium$A_n$; dimethylsilylbis(cyclopentadienyl)zirconium$A_n$; dimethylsilylbis(9-fluorenyl)zirconium$A_n$; dimethylsilylbis(1-indenyl)zirconium$A_n$; dimethylsilylbis(2-methylindenyl)zirconium$A_n$; dimethylsilylbis(2-propylindenyl)zirconium$A_n$; dimethylsilylbis(2-butylindenyl)zirconium$A_n$; diphenylsilylbis(2-methylindenyl)zirconium$A_n$; diphenylsilylbis(2-propylindenyl)zirconium$A_n$; diphenylsilylbis(2-butylindenyl)zirconium$A_n$; dimethylgermylbis(2-methylindenyl)zirconium$A_n$; dimethylsilylbistetrahydroindenylzirconium$A_n$; dimethylsilylbistetramethylcyclopentadienylzirconium$A_n$; dimethylsilyl(cyclopentadienyl)(9-fluorenyl)zirconium$A_n$; diphenylsilyl(cyclopentadienyl)(9-fluorenyl)zirconium$A_n$; diphenylsilylbisindenylzirconium$A_n$; cyclotrimethylenesilyltetramethylcyclopentadienylcyclopentadienylzirconium$A_n$; cyclotetramethylenesilyltetramethylcyclopentadienylcyclopentadienylzirconium$A_n$; cyclotrimethylenesilyl(tetramethylcyclopentadienyl)(2-methylindenyl)zirconium$A_n$; cyclotrimethylenesilyl(tetramethylcyclopentadienyl)(3-methylcyclopentadienyl)zirconium$A_n$; cyclotrimethylenesilylbis(2-methylindenyl)zirconium$A_n$; cyclotrimethylenesilyl(tetramethylcyclopentadienyl)(2,3,5-trimethylclopentadienyl)zirconium$A_n$; cyclotrimethylenesilylbis(tetramethylcyclopentadienyl)zirconium$A_n$; dimethylsilyl(tetramethylcyclopentadieneyl)(N-tertbutylamido)titanium$A_n$; biscyclopentadienylchromium$A_n$; biscyclopentadienylzirconium$A_n$; bis(n-butylcyclopentadienyl)zirconium$A_n$; bis(n-dodecyclcyclopentadienyl)zirconium$A_n$; bisethylcyclopentadienylzirconium$A_n$; bisisobutylcyclopentadienylzirconium$A_n$; bisisopropylcyclopentadienylzirconium$A_n$; bismethylcyclopentadienylzirconium$A_n$; bisoctylcyclopentadienylzirconium$A_n$; bis(n-pentylcyclopentadienyl)zirconium$A_n$; bis(n-propylcyclopentadienyl)zirconium$A_n$; bistrimethylsilylcyclopentadienylzirconium$A_n$; bis(1,3-bis(trimethylsilyl)cyclopentadienyl)zirconium$A_n$; bis(1-ethyl-2-methylcyclopentadienyl)zirconium$A_n$; bis(1-ethyl-3-methylcyclopentadienyl)zirconium$A_n$; bispentamethylcyclopentadienylzirconium$A_n$; bispentamethylcyclopentadienylzirconium$A_n$; bis(1-propyl-3-methylcyclopentadienyl)zirconium$A_n$; bis(1-n-butyl-3-methylcyclopentadienyl)zirconium$A_n$; bis(1-isobutyl-3-methylcyclopentadienyl)zirconium$A_n$; bis(1-propyl-3-butylcyclopentadienyl)zirconium$A_n$; bis(1,3-n-butylcyclopentadienyl)zirconium$A_n$; bis(4,7-dimethylindenyl)zirconium$A_n$; bisindenylzirconium$A_n$; bis(2-methylindenyl)zirconium$A_n$; cyclopentadienylindenylzirconium$A_n$; bis(n-propylcyclopentadienyl)hafnium$A_n$; bis(n-butylcyclopentadienyl)hafnium$A_n$; bis(n-pentylcyclopentadienyl)hafnium$A_n$; (n-propylcyclopentadienyl)(n-butylcyclopentadienyl)hafnium$A_n$; bis[(2-trimethylsilylethyl)cyclopentadienyl]hafnium$A_n$; bis(trimethylsilylcyclopentadienyl)hafnium$A_n$; bis(2-n-propylindenyl)hafnium$A_n$; bis(2-n-butylindenyl)hafnium$A_n$; dimethylsilylbis(n-propylcyclopentadienyl)hafnium$A_n$; dimethylsilylbis(n-butylcyclopentadienyl)hafnium$A_n$; bis(9-n-propylfluorenyl)hafnium$A_n$; bis(9-n-butylfluorenyl)hafnium$A_n$; (9-n-propylfluorenyl)(2-n-propylindenyl)hafnium$A_n$; bis(1-n-propyl-2-methylcyclopentadienyl)hafnium$A_n$; (n-propylcyclopentadienyl)(1-n-propyl-3-n-butylcyclopentadienyl)hafnium$A_n$; dimethylsilyltetramethylcyclopentadienylcyclopropylamidotitanium$A_n$; dimethylsilyltetramethylcyclopentadienylcyclobutylamidotitanium$A_n$; dimethylsilyltetramethylcyclopentadienylcyclopentylamidotitanium$A_n$; dimethylsilyltetramethylcyclopentadienylcyclohexylamidotitanium$A_n$; dimethylsilyltetramethylcyclopentadienylcycloheptylamidotitanium$A_n$; dimethylsilyltetramethylcyclopentadienylcyclooctylamidotitanium$A_n$; dimethylsilyltetramethylcyclopentadienylcyclononylamidotitanium$A_n$; dimethylsilyltetramethylcyclopentadienylcyclodecylamidotitanium$A_n$; dimethylsilyltetramethylcyclopentadienylcycloundecylamidotitanium$A_n$; dimethylsilyltetramethylcyclopentadienylcyclododecylamidotitanium$A_n$; dimethylsilyltetramethylcyclopentadienyl(sec-butylamido)titanium$A_n$; dimethylsilyl(tetramethylcyclopentadienyl)(n-octylamido)titanium$A_n$; dimethylsilyl(tetramethylcyclopentadienyl)(n-decylamido)titanium$A_n$; dimethylsilyl(tetramethylcyclopentadienyl)(n-octadecylamido)titanium$A_n$; dimethylsilylbis(cyclopentadienyl)zirconium$A_n$; dimethylsilylbis (tetramethylcyclopentadienyl)zirconium$A_n$; dimethylsilylbis(methylcyclopentadienyl)zirconium$A_n$; dimethylsilylbis(dimethylcyclopentadienyl)zirconium$A_n$; dimethylsilyl(2,4-dimethylcyclopentadienyl)(3',5'-dimethylcyclopentadienyl)zirconium$A_n$; dimethylsilyl(2,3,5-trimethylcyclopentadienyl)(2',4',5'-dimethylcyclopentadienyl) zirconium$A_n$; dimethylsilylbis(t-butylcyclopentadienyl) zirconium$A_n$; dimethylsilylbis (trimethylsilylcyclopentadienyl)zirconium$A_n$; dimethylsilylbis(2-trimethylsilyl-4-t-butylcyclopentadienyl) zirconium$A_n$; dimethylsilylbis(4,5,6,7-tetrahydro-indenyl) zirconium$A_n$; dimethylsilylbis(indenyl)zirconium$A_n$; dimethylsilylbis(2-methylindenyl)zirconium$A_n$; dimethylsilylbis(2,4-dimethylindenyl)zirconium$A_n$; dimethylsilylbis(2,4,7-trimethylindenyl)zirconium$A_n$; dimethylsilylbis(2-methyl-4-phenylindenyl)zirconium$A_n$; dimethylsilylbis(2-ethyl-4-phenylindenyl)zirconium$A_n$; dimethylsilylbis(benz[e]indenyl)zirconium$A_n$; dimethylsilylbis(2-methylbenz[e]indenyl)zirconium$A_n$; dimethylsilylbis(benz[f]indenyl)zirconium$A_n$; dimethylsilylbis(2-methylbenz[f]indenyl)zirconium$A_n$; dimethylsilylbis(3-methylbenz[f]indenyl)zirconium$A_n$; dimethylsilylbis (cyclopenta[cd]indenyl)zirconium$A_n$; dimethylsilylbis (cyclopentadienyl)zirconium$A_n$; dimethylsilylbis (tetramethylcyclopentadienyl)zirconium$A_n$; dimethylsilylbis(methylcyclopentadienyl)zirconium$A_n$; dimethylsilylbis(dimethylcyclopentadienyl)zirconium$A_n$; isopropylidene(cyclopentadienyl-fluorenyl)zirconium$A_n$; isopropylidene(cyclopentadienyl-indenyl)zirconium$A_n$; isopropylidene(cyclopentadienyl-2,7-di-t-butylfluorenyl)zirconium$A_n$; isopropylidene(cyclopentadienyl-3-methylfluorenyl)zirconium$A_n$; isopropylidene(cyclopentadienyl-4-methylfluorenyl)zirconium$A_n$; isopropylidene (cyclopentadienyl-octahydrofluorenyl)zirconium$A_n$; isopropylidene(methylcyclopentadienyl-fluorenyl)zirconium$A_n$; isopropylidene(dimethylcyclopentadienylfluorenyl) zirconium$A_n$; isopropylidene(tetramethylcyclopentadienyl-fluorenyl)zirconium$A_n$; diphenylmethylene (cyclopentadienyl-fluorenyl)zirconium$A_n$; diphenylmethylene(cyclopentadienyl-indenyl)zirconium$A_n$; diphenylmethylene(cyclopentadienyl-2,7-di-t-butylfluorenyl)zirconium$A_n$; diphenylmethylene(cyclopentadienyl-3-methylfluorenyl)zirconium$A_n$; diphenylmethylene(cyclopentadienyl-4-methylfluorenyl)zirconium$A_n$; diphenylmethylene(cyclopentadienyloctahydrofluorenyl) zirconium$A_n$; diphenylmethylene(methylcyclopentadienyl-fluorenyl)zirconium$A_n$; diphenylmethylene(dimethylcyclopentadienyl-fluorenyl)zirconium$A_n$; diphenylmethylene (tetramethylcyclopentadienyl-fluorenyl)zirconium$A_n$; cyclohexylidene(cyclopentadienyl-fluorenyl)zirconium$A_n$; cyclohexylidene(cyclopentadienylindenyl)zirconium$A_n$; cyclohexylidene(cyclopentadienyl-2,7-di-t-butylfluorenyl) zirconium$A_n$; cyclohexylidene(cyclopentadienyl-3-methylfluorenyl)zirconium$A_n$; cyclohexylidene(cyclopentadienyl-4-methylfluorenyl)zirconium$A_n$; cyclohexylidene (cyclopentadienyloctahydrofluorenyl)zirconium$A_n$; cyclohexylidene(methylcyclopentadienylfluorenyl)zirconium$A_n$; cyclohexylidene(dimethylcyclopentadienyl-fluorenyl)zirconium$A_n$; cyclohexylidene(tetramethylcyclopentadienylfluorenyl)zirconium$A_n$; dimethylsilyl (cyclopentadienyl-fluorenyl)zirconium$A_n$; dimethylsilyl (cyclopentadienyl-indenyl)zirconium$A_n$; dimethylsilyl (cyclopentadienyl-2,7-di-t-butylfluorenyl)zirconium$A_n$; dimethylsilyl(cyclopentadienyl-3-methylfluorenyl)zirconium$A_n$; dimethylsilyl(cyclopentadienyl-4-methylfluorenyl) zirconium$A_n$; dimethylsilyl(cyclopentadienyl-octahydrofluorenyl)zirconium$A_n$; dimethylsilyl (methylcyclopentanedienyl-fluorenyl)zirconium$A_n$; dimethylsilyl(dimethylcyclopentadienylfluorenyl)zirconium$A_n$; dimethylsilyl(tetramethylcyclopentadienylfluorenyl) zirconium$A_n$; isopropylidene(cyclopentadienyl-fluorenyl) zirconium$A_n$; isopropylidene(cyclopentadienyl-indenyl) zirconium$A_n$; isopropylidene(cyclopentadienyl-2,7-di-t-butylfluorenyl)zirconium$A_n$; cyclohexylidene (cyclopentadienylfluorenyl)zirconium$A_n$; cyclohexylidene (cyclopentadienyl-2,7-di-t-butylfluorenyl)zirconium$A_n$; dimethylsilyl(cyclopentadienylfluorenyl)zirconium$A_n$; methylphenylsilyltetramethyl-cyclopentadienylcyclopropylamidotitanium$A_n$; methylphenylsilyltetramethylcyclopentadienylcyclobutylamidotitanium$A_n$; methylphenylsilyltetramethyl-cyclopentadienylcyclopentylamidotitanium$A_n$; methylphenylsilyltetramethylcyclopentadienylcyclohexylamidotitanium$A_n$; methylphenylsilyltetramethyl-cyclopentadienylcycloheptylamidotitanium$A_n$; methylphenylsilyltetramethylcyclopentadienylcyclooctylamidotitanium$A_n$; methylphenylsilyltetramethyl-cyclopentadienylcyclononylamidotitanium$A_n$; methylphenylsilyltetramethylcyclopentadienylcyclodecylamidotitanium$A_n$; methylphenylsilyltetramethyl-cyclopentadienylcycloundecylamidotitanium$A_n$; methylphenylsilyltetramethylcyclopentadienylcyclododecylamidotitanium$A_n$; methylphenylsilyl(tetramethylcyclopentadienyl)(sec-butylamido)titanium$A_n$; methylphenylsilyl(tetramethylcyclopentadienyl)(n-octylamido)titanium$A_n$; methylphenylsilyl(tetramethylcyclopentadienyl)(n-decylamido)titanium$A_n$; methylphenylsilyl(tetramethylcyclopentadienyl)(n-octadecylamido)titanium$A_n$; diphenylsilyltetramethylcyclopentadienylcyclopropylamidotitanium$A_n$; diphenylsilyltetramethylcyclopentadienylcyclobutylamidotitanium$A_n$; diphenylsilyltetramethylcyclopentadienylcyclopentylamidotitanium$A_n$; diphenylsilyltetramethylcyclopentadienylcyclohexylamidotitanium$A_n$; diphenylsilyltetramethylcyclopentadienylcycloheptylamidotitanium$A_n$; diphenylsilyltetramethylcyclopentadienylcyclooctylamidotitanium$A_n$; diphenylsilyltetramethylcyclopentadienylcyclononylamidotitanium$A_n$; diphenyisilyltetramethylcyclopentadienylcyclodecylamidotitanium$A_n$; diphenylsilyltetramethylcyclopentadienylcycloundecylamidotitanium$A_n$; diphenylsilyltetramethylcyclopentadienylcyclododecylamidotitanium$A_n$; diphenylsilyl (tetramethylcyclopentadienyl)(sec-butylamido)titanium$A_n$; diphenylsilyl(tetramethylcyclopentadienyl)(n-octylamido) titanium$A_n$; diphenylsilyl(tetramethylcyclopentadienyl)(n-decylamido)titanium$A_n$; and diphenylsilyl(tetramethylcyclopentadienyl)(n-octadecylamido)titanium$A_n$.

The metallocene catalysts may be activated with a metallocene activator for subsequent polymerization. As used herein, the term "metallocene activator" is defined to be any compound or combination of compounds, supported or unsupported, which may activate a single-site catalyst compound (e.g., metallocenes, Group 15 containing catalysts, etc.) This may involve the abstraction of at least one leaving group (A group in the formulas/structures above, for example) from the metal center of the catalyst component. The metallocene catalysts are thus activated towards olefin polymerization using such activators.

Embodiments of such activators include Lewis acids, such as cyclic or oligomeric polyhydrocarbylaluminum oxides, non-coordinating ionic activators (NCA), ionizing activators, stoichiometric activators, combinations thereof or any other compound that may convert a neutral metallocene catalyst component to a metallocene cation that is active with respect to olefin polymerization.

The Lewis acids may include alumoxane (e.g., "MAO"), modified alumoxane (e.g., "TIBAO") and alkylaluminum compounds, for example. Non-limiting examples of aluminum alkyl compounds may include trimethylaluminum, triethylaluminum, triisobutylalumintum, tri-n-hexylaluminum and tri-n-octylaluminum, for example.

Ionizing activators are well known in the art and are described by, for example, Eugene You-Xian Chen & Tobin J. Marks, *Cocatalysts for Metal-Catalyzed Olefin Polymerization: Activators, Activation Processes, and Structure-Activity Relationships* 100(4) *CHEMICAL REVIEWS* 1391-1434 (2000). Examples of neutral ionizing activators include Group 13 tri-substituted compounds, in particular, tri-substituted boron, tellurium, aluminum, gallium and indium compounds and mixtures thereof (e.g., trisperfluorophenyl boron metalloid precursors), for example. The substituent groups may be independently selected from alkyls, alkenyls, halogen, substituted alkyls, aryls, arylhalides, alkoxy and halides, for example. In one embodiment, the three groups are independently selected from halogens, mono or multicyclic (including halosubstituted) aryls, alkyls, alkenyl compounds and mixtures thereof, for example. In another embodiment, the three groups are selected from $C_1$ to $C_{20}$ alkenyls, $C_1$ to $C_{20}$ alkyls, $C_1$ to $C_{20}$ alkoxys, $C_3$ to $C_{20}$ aryls and combinations thereof, for example. In yet another embodiment, the three groups are selected from the group highly halogenated $C_1$ to $C_4$ alkyls, highly halogenated phenyls, and highly halogenated naphthyls and mixtures thereof, for example. By "highly halogenated", it is meant that at least 50% of the hydrogens are replaced by a halogen group selected from fluorine, chlorine and bromine.

Illustrative, not limiting examples of ionic ionizing activators include trialkyl-substituted ammonium salts (e.g., triethylammoniumtetraphenylborate, tripropylammoniumtetraphenylborate, tri(n-butyl)ammoniumtetraphenylborate, trimethylammoniumtetra(p-tolyl)borate, trimethylammoniumtetra(o-tolyl)borate, tributylammoniumtetra(pentafluorophenyl)borate, tripropylammoniumtetra(o,p-dimethylphenyl)borate, tributylammoniumtetra(m,m-dimethylphenyl)borate, tributylammoniumtetra(p-tri-fluoromethylphenyl)borate, tributylammoniumtetra(pentafluorophenyl)borate and tri(n-butyl)ammoniumtetra(o-tolyl)borate), N,N-dialkylanilinium salts (e.g., N,N-dimethylaniliniumtetraphenylborate, N,N-diethylaniliniumtetraphenylborate and N,N-2,4,6-pentamethylaniliniumtetraphenylborate), dialkyl ammonium salts (e.g., diisopropylammoniumtetrapentafluorophenylborate and dicyclohexylammoniumtetraphenylborate), triaryl phosphonium salts (e.g., triphenylphosphoniumtetraphenylborate, trimethylphenylphosphoniumtetraphenylborate and tridimethylphenylphosphoniumtetraphenylborate) and their aluminum equivalents, for example.

In yet another embodiment, an alkylaluminum compound may be used in conjunction with a heterocyclic compound. The ring of the heterocyclic compound may include at least one nitrogen, oxygen, and/or sulfur atom, and includes at least one nitrogen atom in one embodiment. The heterocyclic compound includes 4 or more ring members in one embodiment, and 5 or more ring members in another embodiment, for example.

The heterocyclic compound for use as an activator with an alkylaluminum compound may be unsubstituted or substituted with one or a combination of substituent groups. Examples of suitable substituents include halogens, alkyls, alkenyls or alkynyl radicals, cycloalkyl radicals, aryl radicals, aryl substituted alkyl radicals, acyl radicals, aroyl radicals, alkoxy radicals, aryloxy radicals, alkylthio radicals, dialkylamino radicals, alkoxycarbonyl radicals, aryloxycarbonyl radicals, carbomoyl radicals, alkyl- or dialkyl-carbamoyl radicals, acyloxy radicals, acylamino radicals, aroylamino radicals, straight, branched or cyclic, alkylene radicals or any combination thereof, for example.

Non-limiting examples of hydrocarbon substituents include methyl, ethyl, propyl, butyl, pentyl, hexyl, cyclopentyl, cyclohexyl, benzyl, phenyl, fluoromethyl, fluoroethyl, difluoroethyl, iodopropyl, bromohexyl or chlorobenzyl, for example.

Non-limiting examples of heterocyclic compounds utilized include substituted and unsubstituted pyrroles, imidazoles, pyrazoles, pyrrolines, pyrrolidines, purines, carbazoles, indoles, phenyl indoles, 2,5-dimethylpyrroles, 3-pentafluorophenylpyrrole, 4,5,6,7-tetrafluoroindole or 3,4-difluoropyrroles, for example.

Combinations of activators are also contemplated by the invention, for example, alumoxanes and ionizing activators in combinations. Other activators include aluminum/boron complexes, perchlorates, periodates and iodates including their hydrates, lithium (2,2'-bisphenyl-ditrimethylsilicate)-4T-HF and silylium salts in combination with a non-coordinating compatible anion, for example. In addition to the compounds listed above, methods of activation, such as using radiation and electro-chemical oxidation are also contemplated as activating methods for the purposes of enhancing the activity and/or productivity of a single-site catalyst compound, for example. (See, U.S. Pat. No. 5,849,852, U.S. Pat. No. 5,859,653, U.S. Pat. No. 5,869,723 and WO 98/32775.)

The catalyst may be activated in any manner known to one skilled in the art. For example, the catalyst and activator may be combined in molar ratios of activator to catalyst of from 1000:1 to 0.1:1, or from 500:1 to 1:1, or from about 100:1 to about 250:1, or from 150:1 to 1:1, or from 50:1 to 1:1, or from 10:1 to0.5:1 or from 3:1 to 0.3:1, for example.

The activators may or may not be associated with or bound to a support, either in association with the catalyst (e.g., metallocene) or separate from the catalyst component, such as described by Gregory G. Hlatky, *Heterogeneous Single-Site Catalysts for Olefin Polymerization* 100(4) *CHEMICAL REVIEWS* 1347-1374 (2000).

Metallocene Catalysts may be supported or unsupported. Typical support materials may include talc, inorganic oxides, clays and clay minerals, ion-exchanged layered compounds, diatomaceous earth compounds, zeolites or a resinous support material, such as a polyolefin, for example.

Specific inorganic oxides include silica, alumina, magnesia, titania and zirconia, for example. The inorganic oxides used as support materials may have an average particle size of from 5 microns to 600 microns or from 10 microns to 100 microns, a surface area of from 50 $m^2/g$ to 1,000 $m^2/g$ or from 100 $m^2/g$ to 400 $m^2/g$ and a pore volume of from 0.5 cc/g to 3.5 cc/g or from 0.5 cc/g to 2.5 cc/g, for example.

Methods for supporting metallocene catalysts are generally known in the art. (See, U.S. Pat. No. 5,643,847, which is incorporated by reference herein.)

Optionally, the support material, the catalyst component, the catalyst system or combinations thereof, may be contacted with one or more scavenging compounds prior to or during polymerization. The term "scavenging compounds" is meant to include those compounds effective for removing impurities (e.g., polar impurities) from the subsequent polymerization reaction environment. Impurities may be inadvertently introduced with any of the polymerization reaction components, particularly with solvent, monomer and catalyst feed, and adversely affect catalyst activity and stability. Such impurities may result in decreasing, or even elimination, of catalytic activity, for example. The polar impurities or catalyst poisons may include water, oxygen and metal impurities, for example.

The scavenging compound may include an excess of the aluminum containing compounds described above, or may be additional known organometallic compounds, such as Group 13 organometallic compounds. For example, the scavenging compounds may include triethyl aluminum (TMA), triisobutyl aluminum (TIBAl), methylalumoxane (MAO), isobutyl aluminoxane and tri-n-octyl aluminum. In one specific embodiment, the scavenging compound is TIBAl.

In one embodiment, the amount of scavenging compound is minimized during polymerization to that amount effective to enhance activity and avoided altogether if the feeds and polymerization medium may be sufficiently free of impurities.

Polymerization Processes

As indicated elsewhere herein, catalyst systems are used to form polyolefin compositions. Once the catalyst system is prepared, as described above and/or as known to one skilled in the art, a variety of processes may be carried out using that composition. The equipment, process conditions, reactants, additives and other materials used in polymerization processes will vary in a given process, depending on the desired composition and properties of the polymer being formed. Such processes may include solution phase, gas phase, slurry phase, bulk phase, high pressure processes or combinations thereof, for example. (See, U.S. Pat. No. 5,525,678; U.S. Pat. No. 6,420,580; U.S. Pat. No. 6,380,328; U.S. Pat. No. 6,359,072; U.S. Pat. No. 6,346,586; U.S. Pat. No. 6,340,730; U.S. Pat. No. 6,339,134; U.S. Pat. No. 6,300,436; U.S. Pat. No. 6,274,684; U.S. Pat. No. 6,271,323; U.S. Pat. No. 6,248,845; U.S. Pat. No. 6,245,868; U.S. Pat. No. 6,245,705; U.S. Pat. No. 6,242,545; U.S. Pat. No. 6,211,105; U.S. Pat. No. 6,207,606; U.S. Pat. No. 6,180,735 and U.S. Pat. No. 6,147,173, which are incorporated by reference herein.)

In certain embodiments, the processes described above generally include polymerizing one or more olefin monomers to form polymers. The olefin monomers may include $C_2$ to $C_{30}$ olefin monomers, or $C_2$ to $C_{12}$ olefin monomers (e.g., ethylene, propylene, butene, pentene, methylpentene, hexene, octene and decene), for example. The monomers may include olefinic unsaturated monomers, $C_4$ to $C_{18}$ diolefins, conjugated or nonconjugated dienes, polyenes, vinyl monomers and cyclic olefins, for example. Non-limiting examples of other monomers may include norbornene, nobornadiene, isobutylene, isoprene, vinylbenzocyclobutane, sytrene, alkyl substituted styrene, ethylidene norbornene, dicyclopentadiene and cyclopentene, for example. The formed polymer may include homopolymers, copolymers or terpolymers, for example.

Examples of solution processes are described in U.S. Pat. No. 4,271,060, U.S. Pat. No. 5,001,205, U.S. Pat. No. 5,236,998 and U.S. Pat. No. 5,589,555, which are incorporated by reference herein.

One example of a gas phase polymerization process includes a continuous cycle system, wherein a cycling gas stream (otherwise known as a recycle stream or fluidizing medium) is heated in a reactor by heat of polymerization. The heat is removed from the cycling gas stream in another part of the cycle by a cooling system external to the reactor. The cycling gas stream containing one or more monomers may be continuously cycled through a fluidized bed in the presence of a catalyst under reactive conditions. The cycling gas stream is generally withdrawn from the fluidized bed and recycled back into the reactor. Simultaneously, polymer product may be withdrawn from the reactor and fresh monomer may be added to replace the polymerized monomer. The reactor pressure in a gas phase process may vary from about 100 psig to about 500 psig, or from about 200 psig to about 400 psig or from about 250 psig to about 350 psig, for example. The reactor temperature in a gas phase process may vary from about 30° C. to about 120° C., or from about 60° C. to about 115° C., or from about 70° C. to about 110° C. or from about 70° C. to about 95° C., for example. (See, for example, U.S. Pat. No. 4,543,399; U.S. Pat. No. 4,588,790; U.S. Pat. No. 5,028,670; U.S. Pat. No. 5,317,036; U.S. Pat. No. 5,352,749; U.S. Pat. No. 5,405,922; U.S. Pat. No. 5,436,304; U.S. Pat. No. 5,456,471; U.S. Pat. No. 5,462,999; U.S. Pat. No. 5,616,661; U.S. Pat. No. 5,627,242; U.S. Pat. No. 5,665,818; U.S. Pat. No. 5,677,375 and U.S. Pat. No. 5,668,228, which are incorporated by reference herein.)

Slurry phase processes generally include forming a suspension of solid, particulate polymer in a liquid polymerization medium, to which monomers and optionally hydrogen, along with catalyst, are added. The suspension (which may include diluents) may be intermittently or continuously removed from the reactor where the volatile components can be separated from the polymer and recycled, optionally after a distillation, to the reactor. The liquefied diluent employed in the polymerization medium may include a $C_3$ to $C_7$ alkane (e.g., hexane or isobutane), for example. The medium employed is generally liquid under the conditions of polymerization and relatively inert. A bulk phase process is similar to that of a slurry process with the exception that the liquid medium is also the reactant (e.g., monomer) in a bulk phase process. However, a process may be a bulk process, a slurry process or a bulk slurry process, for example.

In a specific embodiment, a slurry process or a bulk process may be carried out continuously in one or more loop reactors. The catalyst, as slurry or as a dry free flowing powder, may be injected regularly to the reactor loop, which can itself be filled with circulating slurry of growing polymer particles in a diluent, for example. Optionally, hydrogen may be added to the process, such as for molecular weight control of the resultant polymer. The loop reactor may be maintained at a pressure of from about 27 bar to about 50 bar or from about 35 bar to about 45 bar and a temperature of from about 38° C. to about 121° C., for example. Reaction heat may be removed through the loop wall via any method known to one skilled in the art, such as via a double-jacketed pipe or heat exchanger, for example.

Alternatively, other types of polymerization processes may be used, such as stirred reactors in series, parallel or combinations thereof, for example. Upon removal from the reactor, the polymer may be passed to a polymer recovery system for further processing, such as addition of additives and/or extrusion, for example.

Polymer Product

The polymers (and blends thereof) formed via the processes described herein may include, but are not limited to, linear low density polyethylene, elastomers, plastomers, high density polyethylenes, low density polyethylenes, medium density polyethylenes, polypropylene and polypropylene copolymers, for example.

Unless otherwise designated herein, all testing methods are the current methods at the time of filing.

In one or more embodiments, the polymer is a propylene based polymer. Unless otherwise specified, the term "propylene based polymer" refers to polypropylene having at least about 50 wt. %, or at least about 80 wt. %, or at least about 85 wt. %, or at least about 90 wt. % or at least about 95 wt. % polypropylene based on the total weight of polymer.

In one or more embodiments, the polymer is a polypropylene homopolymer. Unless othervise specified, the term "polypropylene homopolymer" refers to those polymers composed primarily of propylene and limited amounts of other comonomers, such as ethylene, wherein the comonomer make up less than about 0.5 wt. %, or less than about 0.3 wt. %, or less than about 0.2 wt. % or less than about 0.1 wt. % by weight of polymer, for example.

In one or more embodiments, the polymer is a propylene based copolymer. The comonomer may be selected from ethylene, $C_4$-$C_{10}$ olefins and combinations thereof, for example. In one or more embodiments, the comonomer is ethylene.

The propylene based copolymer may include at least about 0.5 wt. %, or at least about 1 wt. %, or at least about 2 wt. %, or from about 0.5 wt. % to about 10 wt. % copolymer, for example. In one or more embodiments, the polymer is a propylene based random copolymer. The term "random copolymer" refers to a copolymer consisting of macromolecules in which the probability of finding a given monomeric unit at any given site in the polymer chain is independent of the nature of the adjacent units. In one or more embodiments, the propylene based random copolymer is a mini-random copolymer. As used herein, the term "mini-random copolymer" refers to a random copolymer including from about 0.2 wt. % to about 1.0 wt. % or from about 0.2 wt. % to about 0.8 wt. % copolymer.

In one or more embodiments, the propylene polymers may have a molecular weight distribution ($M_wM_n$) of from about 1.5 to about 8, or from about 2 to about 4 or from about 3 to about 8, for example.

In addition, the propylene polymers may have a melt flow rate (MFR) (as measured by ASTM D-1238) of from about 0.01 dg/min to about 1000 dg/min., or from about 0.01 dg/min. to about 100 dg/min. or from about 5 dg/min. to about 60 dg/min., for example.

In one or more embodiments, the propylene polymer has a microtacticity of from about 89% to about 99.8%, for example. The term "tacticity" refers to the spatial arrangement of pendant groups in a polymer. For example, a polymer is "atactic" when its pendant groups are arranged in a random fashion on both-sides of a hypothetical plant through the main chain of the polymer. In contrast, a polymer is "isotactic" when all its pendant groups are arranged on the same side of the chain and "syndiotactic" when its pendant groups alternate on opposite sides of the chain. The tacticity of a polymer may be analyzed via NMR spectroscopy, wherein "mmmm" (meso pentad) designates isotactic units and "rrrr" (racemic pentad) designates syndiotactic units. In one or more embodiments, the propylene based polymer is isotactic.

In one or more embodiments, the propylene based polymers have a xylene solubles level of less than about 5%, or less than 2% or less than 1%, for example.

In one or more embodiments, the propylene based polymers are formed from metallocene catalyst systems (hereinafter referred to as metallocene polypropylene). The propylene based polymers may be formed by only the metallocene catalyst system or by a plurality of catalyst systems. However, when a plurality of catalyst systems are utilized to form the propylene based polymer, the metallocene catalyst comprises at least 50% of the total catalyst composition.

In one or more embodiments, the polymer is a blend of polymers. When the polymer is a blend, it is contemplated that at least a portion of the blend (at least one of the polymers) is formed by a metallocene catalyst.

Product Application

The polymers and blends thereof are useful in applications known to one skilled in the art, such as forming operations (e.g., film, sheet, pipe and fiber extrusion and co-extrusion as well as blow molding, injection molding and rotary molding). Films include blown, oriented or cast films formed by extrusion or co-extrusion or by lamination useful as shrink film, cling film, stretch film, sealing films, oriented films, snack packaging, heavy duty bags, grocery sacks, baked and frozen food packaging, medical packaging, industrial liners, and membranes, for example, in food-contact and non-food contact application. Fibers include slit-films, monofilaments, melt spinning, solution spinning and melt blown fiber operations for use in woven or non-woven form to make sacks, bags, rope, twine, carpet backing, carpet yarns, filters, diaper fabrics, medical garments and geotextiles, for example. Extruded articles include medical tubing, wire and cable coatings, sheet, thermoformed sheet, geomembranes and pond liners, for example. Molded articles include single and multi-layered constructions in the form of bottles, tanks, large hollow articles, rigid food containers and toys, for example.

One or more embodiments include forming multi-component fibers. The multi-component fibers may be formed by methods, such as those described in U.S. Pat. No. 6,074,590, which is incorporated herein by reference. Generally, multi-component fibers are formed by co-extrusion of at least two different components into one fiber or filament. The resulting fiber includes at least two different essentially continuous polymer phases. In one non-limiting embodiment, the multi-component fibers include bicomponent fibers.

Bicomponent fibers of the present invention generally include a first component formed from a first metallocene polypropylene (e.g., the core) generally surrounded by a second component formed from a second metallocene polypropylene (e.g., the sheath).

In one embodiment, the first metallocene polypropylene and the second metallocene polypropylene are the same.

In another embodiment, the first metallocene polypropylene and the second metallocene polypropylene are different.

In one or more embodiments, the first metallocene polypropylene is a propylene based random copolymer. For example, the propylene based random copolymer may be a mini-random copolymer.

The first component may be present in an amount of from about 90% to about 10%, or from about 70% to about 30% or from about 60% to about 40% based on the total amount of multi-component fiber, for example. The second component may be present in an amount of from about 10% to about 90%, or from about 30% to about 70% or from about 40% to about 60% based on the total amount of multi-component fiber, for example.

In one or more embodiments, the first metallocene polypropylene and the second metallocene polypropylene have a melting point difference of less than about 50° C., or less than about 40° C., or less than about 30° C., or less than about 20° C. or less than about 10° C., for example.

In one or more embodiments, the first metallocene polypropylene is melted at a temperature that is at least 10° C., or at least about 12° C. or at least about 15° C. different than a melt temperature of the second metallocene polypropylene during formation of the bicomponent fiber. In one specific embodiment, the first metallocene polypropylene is melted at a temperature that is lower than the melt temperature of the second metallocene polypropylene.

The bicomponent fibers of the present invention may be utilized to form spunbond non-woven articles, for example. The spunbond non-woven articles can be produced by any suitable method. The spunbond non-woven articles may include thermally bonded articles, such as medical gowns and drapes, diapers and filters, for example.

Unexpectedly, embodiments of the invention can result in improved drape in the spunbond non-woven articles over non bicomponent fibers formed from the same polymer. As used herein, the term "drape" refers to the ability of the spunbond non-woven articles to assume a shape and is measured by ISO 9073-9.

EXAMPLES

As used in the examples, Polymer "A" is a polypropylene random copolymer formed from dimethylsilylbis(2-methyl-4-phenyl-indenyl)zirconium dichloride having a melt flow rate (MFR) of 30 g/10 min. and a melting point ($T_m$) of 135° C.

As used in the examples, Polymer "B" is a polypropylene random copolymer commercially available from TOTAL PETROCHEMICALS, USA, Inc. as EOD 05-14 formed from dimethylsilylbis(2-methyl-4-phenyl-indenyl)zirconium dichloride having a melt flow rate (MFR) of 50 g/10 min. and a melting point ($T_m$) of 120° C.

As used in the examples, Polymer "C" is a polypropylene random copolymer commercially available from TOTAL PETROCHEMICALS, USA, Inc. as EOD 02-15 formed from dimethylmethylene(fluorenyl)(2-methyl-4-tert-butyl-cyclopentadienyl)zirconium dichloride having a melt flow rate (MFR) of 12 g/10 min. and a melting point ($T_m$) of 120° C.

As used in the examples, Polymer "D" is an isotactic polypropylene commercially available from TOTAL PETROCHEMICALS, USA, Inc. as MR2001 formed from dimethylmethylene(fluorenyl)(2-methyl-4-tert-butyl-cyclopentadienyl)zirconium dichloride having a melt flow rate (MFR) of 25 g/10 min. and a melting point ($T_m$) of 150° C.

Spunbond structures were formed on a 1.1 m wide, single beam. Reicofil 4 pilot bicomponent spunbond line from the polymers described above and identified in Table 1 as follows. The results of analysis of the structures follow in Table 2 below.

TABLE 1

| Run | Sheath Material | Sheath amount (wt. %) | Core Material | Core Amount (wt. %) | Sheath melt temp (C) | Core melt temp | Draw Pressure (mPa) |
|---|---|---|---|---|---|---|---|
| 1 | N/A | N/A | D | 100 | N/A | 245 | 8000 |
| 2 | A | 30 | D | 70 | 245 | 245 | 8000 |
| 3 | A | 30 | D | 70 | 230 | 245 | 8000 |
| 4 | A | 20 | D | 80 | 230 | 245 | 8000 |
| 5 | A | 10 | D | 90 | 245 | 245 | 8000 |
| 6 | B | 30 | D | 70 | 245 | 245 | 8000 |
| 7 | B | 20 | D | 80 | 245 | 245 | 8000 |
| 8 | B | 10 | D | 90 | 245 | 245 | 8000 |
| 9 | BD/B 80:20 | 30 | D | 70 | 245 | 245 | 8000 |

TABLE 2

| Run | Titer (dtex) | Strength MD (N/5 cm | Strength CD (N/5 cm) | MD/CD | Elongation MD (%) | Elongation CD (%) | Drape (%) ISO 9073-9 |
|---|---|---|---|---|---|---|---|
| 1 | 1.06 | 35.7 | 17.0 | 2.1 | 59 | 55 | 62 |
| 2 | 1.4 | 32.8 | 19.1 | 1.7 | 72 | 77 | NR |
| 3 | 1.4 | 33.9 | 21.5 | 1.6 | 76 | 90 | 53 |
| 4 | 1.3 | 33.5 | 20.8 | 1.6 | 76 | 86 | NR |
| 5 | 1.3 | 34.2 | 20.2 | 1.7 | 70 | 77 | NR |
| 6 | 1.2 | 19.6 | 10.8 | na | 66 | 72 | 57 |
| 7 | 1.15 | 19 | 10.7 | na | 52 | 67 | 56 |
| 8 | 1.1 | 17.6 | 10.9 | na | 53 | 67 | NR |
| 9 | 1.15 | 34.7 | 16.4 | na | 58 | 64 | NR |

*NR means not recorded. MD refers to stretching in the machine direction, titer refers to thickness of the fiber All bicomponent configurations processed well and resulted in spunbond fabrics with good formation. The use of metallocene resins for both the sheath and core components significantly contributed to the good performance. The low xylene solubles and narrow molecular weight distribution of both components allowed for consistent filaments and clean processing.

Compared to the standard made from 100% MR2001 (Polymer D), bicomponent structures formed from the embodiments of the invention showed improved drape. In some configurations, bicomponent structures showed increased fabric elongation and improved CD/MD tensile strength balance. Higher fabric elongations are often required for nonwovens structures that incorporate an elastic lamination component.

While the foregoing is directed to embodiments of the present invention, other and further embodiments of the invention may be devised without departing from the basic scope thereof and the scope thereof is determined by the claims that follow.

What is claimed is:

1. A process of forming a bicomponent fiber comprising:

providing a first metallocene polypropylene comprising a first melting temperature and a second metallocene polypropylene comprising a second melting temperature;

melting the first and second metallocene polypropylenes at their respective first and second melting temperatures, thereby providing a first and second melted metallocene polypropylene; and forming the first and second melted metallocene polypropylenes into a bicomponent fiber comprising a sheath component formed from the first metallocene polypropylene and a core component formed from the second metallocene polypropylene, wherein the first melting temperature is at least about 10° C. lower than the second melting temperature.

2. The process of claim 1 further comprising forming the bicomponent fiber into a spunbond article.

3. The process of claim 2. wherein the bicomponent fiber exhibits improved drape over non bicomponent fibers formed from the same polymer.

4. The process of claim 1, wherein the first metallocene polypropylene exhibits a molecular weight distribution of from about 1.5 to about 8.

5. The process of claim 1, wherein there is difference in the first melting point and the second melting point of less than about 20° C.

6. The process of claim 1, wherein a weight ratio of the sheath component to the core component is from about 10:90 to about 30:70.

* * * * *